US005699818A

United States Patent [19]

Carpenter, Jr.

[11] Patent Number: 5,699,818

[45] Date of Patent: Dec. 23, 1997

[54] PERSONAL SAFETY SYSTEM

[75] Inventor: Roy B. Carpenter, Jr., Boulder, Colo.

[73] Assignee: Lightning Eliminators & Consultants, Inc., Boulder, Colo.

[21] Appl. No.: 590,706

[22] Filed: Nov. 16, 1995

[51] Int. Cl.[6] ..... A45B 23/00

[52] U.S. Cl. ..... 135/16; 135/15.1; 135/20.2; 135/21; 135/33.2; 174/5.5 B

[58] Field of Search ..... 135/16, 33.2, 33.71, 135/20.2, 98, 15.1, 33.41, 21, 90, 27; 174/5 R, 5.5 B, 5.5 G, 6, 7

[56] References Cited

U.S. PATENT DOCUMENTS

| | | | |
|---|---|---|---|
| 2,434,526 | 1/1948 | Thornton | 135/16 |
| 3,554,203 | 1/1971 | Hall, Sr. | 135/16 |
| 3,910,631 | 10/1975 | Inaba | 135/16 X |
| 4,131,954 | 1/1979 | Brock et al. | 135/16 X |
| 4,188,965 | 2/1980 | Morman | 135/16 |
| 4,370,994 | 2/1983 | Pittman | 135/20.2 |

FOREIGN PATENT DOCUMENTS

| | | | |
|---|---|---|---|
| 1567167 | 5/1990 | U.S.S.R. | 135/33.2 |

*Primary Examiner*—Wynn E. Wood
*Assistant Examiner*—Timothy B. Kang
*Attorney, Agent, or Firm*—Rick Martin

[57] ABSTRACT

A lightning shield reduces the chance for a direct hit on a person by placing an inverted hemispherical dome over the person's head and shoulders. The dome has a conductive covering, preferably a wire mesh. The dome thwarts ground leaders from completing a circuit to a descending lightning streamer from a cloud. Embodiments include umbrellas, backpack models, balloons, and mini-shelters.

6 Claims, 4 Drawing Sheets

PERSONAL SAFETY SYSTEM

FIELD OF INVENTION

The present invention relates to protecting a hiker from lightning. Various domed embodiments keep a smooth curved surface over the hiker's head. The preferred embodiment pops out of a backpack in the shape of an umbrella.

BACKGROUND OF THE INVENTION

Direct lightning strikes to people in open areas is the major cause of lightning related deaths. Persons on golf courses, athletic fields, mountains, and farms prove to be very vulnerable. These activities require long exposure in open fields. There has been a significant level of interest in finding a way to reduce the risk of a strike to these people. This invention offers an inexpensive way of achieving this objective.

To understand the value of the Personal Lightning Protection Modules (PLPM), it is first necessary to comprehend the lightning discharge mechanism, and in particular, the termination mechanism. That is, why does lightning strike what it strikes. According to Dr. M. Uman in his book *The Lightning Discharge,* the path of a lightning discharge is random until it reaches one step distance from earth. We know that lighting progresses in steps from the storm cell toward the earth. These steps have been found to measure between 10 and 260 meters in length. The strike terminus is determined when the step leader reaches one step before earth. Selection of the terminus is a competitive event. The most attractive terminal "wins". The competition is between various rising streamer generators within the strike zone. The strike zone is a hemispheric volume, the radius of which is equal to a step length.

The first rising streamer that reaches the incoming leader closes the circuit and initiates the strike. The PLPM is designed so as to discharge the formation and propagation of the streamers, and to minimize the generation of corona, a precursor to a streamer.

To that end, it can be shown that well rounded objects limit the formation of corona. Further, the larger the diameter of the rounded object the greater the voltage required to create corona (or streamer). This invention is based on the premise that a large curved surface will provide the required protection. Further, since that curved surface must be true for a full 360 degrees around the object to be protected, a hemispheric shape would be the most appropriate configuration for the PLPM. However, it is recognized that other rounded shapes such as a half cylinder may be appropriate where groups are involved.

A second factor of significance must be considered, that of the character of the PLPM hemispheric material. Otherwise, a common umbrella may be considered to qualify. Since it is the electric field that encourages the formation of streamers (and corona), the PLPM hemisphere must be of a material that will contour the electric field and prevent it from penetrating into the protective hemisphere.

The material must be conductive, but it does not have to carry any current flow. From the above information, it is, therefore, obvious that many configurations can be devised that will satisfy the two criteria. A configuration must approximate a hemispherical shape or significant portion thereof, and be composed of a conductive surface. The configuration may be a fixed or deployable assembly.

SUMMARY OF THE INVENTION

The primary object of the present invention is to provide a portable lightning shield having a smooth, domed conductive surface.

Another object of the present invention is to provide a means to support the shield over the person's head.

An object of an alternate embodiment is to provide a larger shield capable of protecting more than one person.

Other objects of this invention will appear from the following description and appended claims, reference being had to the accompanying drawings forming a part of this specification wherein like reference characters designate corresponding parts in the several views.

In order to reduce the chance of a lightning strike, it is desirable to mount a smooth dome over the hiker's head. The greater the diameter of the dome, the greater the protection. The dome must be smooth. The dome must be made from a conductive material including metal. Preferably the dome must be of a very flexible metallic cloth. That cloth must not have any sharp points. The smooth surface decreases the chances of a lightning strike.

One preferred embodiment is a modified umbrella type configuration. However, two important innovations are required. First, it should be more hemispherical in shape for best results. A typical umbrella shape with a conductive coating will function well, but with some increased risk. It is covered by this patent.

Second, it must not have any discontinuities on the upper surface. That is, no knobs, points, end wires, or like protrusions within ±90° of the vertical. A smooth surface is the most effective.

A metalized balloon is another configuration. One option for the device is one that can be attached to the head in the form of a hat to stabilize the sphere over the head. A second option is one where a larger diameter balloon is inflated and deployed over one or more people.

Another configuration is a fixed installation. The actual size would vary with the application. A small one suffices for one person. Large radii hemispheres suffice for multi-personnel shelters or a half section of a round end cylinder, such as those required for golf courses.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Lightning can strike anywhere. Hikers, golfers, and hunters are killed every year by lightning strikes. The present invention is designed to save lives by reducing the odds of a lighting strike terminating directly on the person. A pictorial discussion of the basic principles of lighting termination theory follows below.

Figure 1:
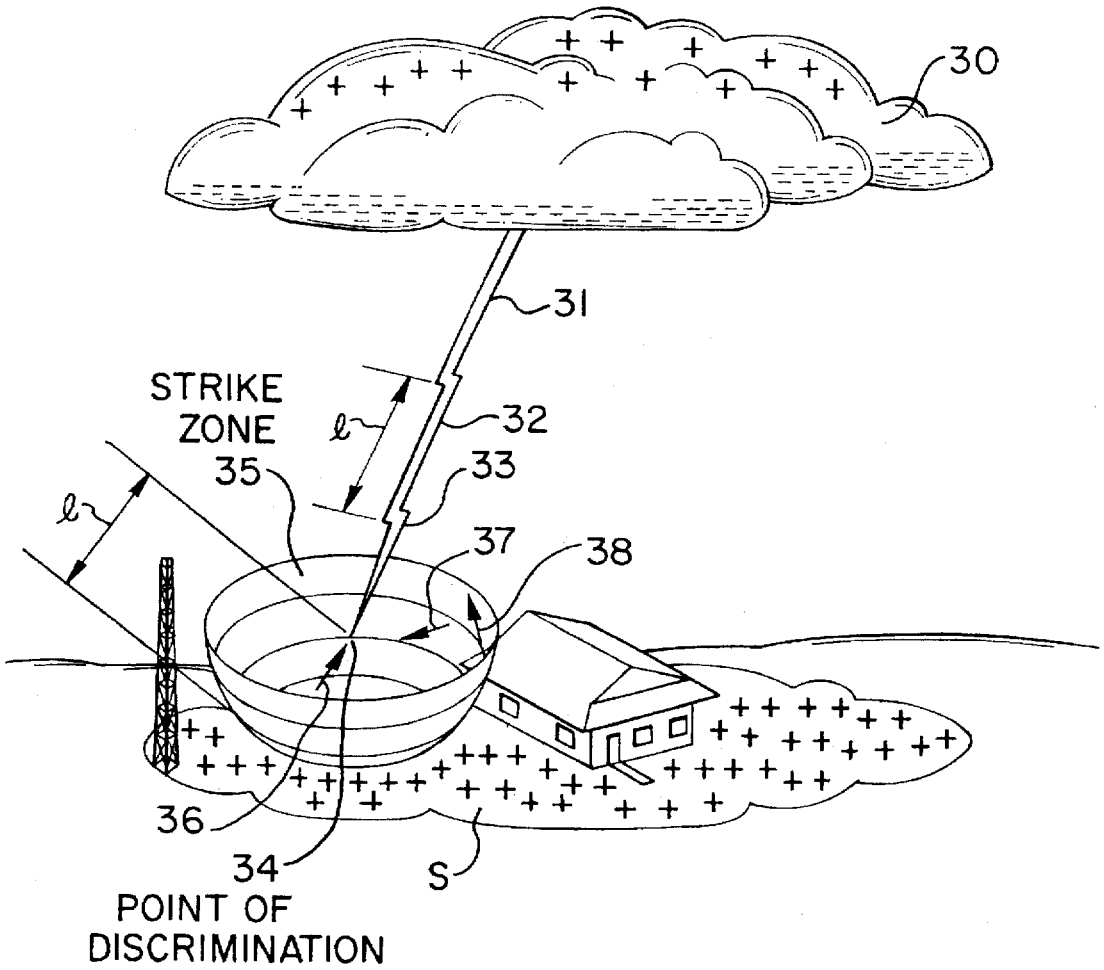
FIG. 1 (PRIOR ART)
FIG. 1 (prior art) is a diagram of a typical lightning strike.

Referring to FIG. 1 lightning moves from the cloud 30 toward earth in "steps" 31, 32, 33. The steps are approximately of equal length l. The length l is related to the strike current during the discharge. Typical lengths range from 10 to 260 meters. The path is random until just before the last step. At that point, the "point of discrimination" 34, and the strike zones are established. Also, the terminus of the strike is selected.

Terminus "selection" is made from "competing" streamers that are rising from facilities below, but within the strike zone 35. The strike zone 35 is an inverted hemisphere with a radius approximately equal to one step length l of the downward moving step leader. To collect the strike, the terminus must generate the most competitive streamer within the strike zone. It must reach the leader quicker than the other streamers in that zone. The first rising streamer that reaches the incoming leaders closes the circuit and initiates the strike. Streamer 36 has won the competition over streamers 37, 38. The main object of the present invention is to reduce the odds for a hiker to close the circuit.

To identify the best streamer generator, it is well known that the sharper the point, the quicker it will make the transition to corona and then to a streamer. Further, that point must be oriented toward and on the same axis as the incoming leader. The greater the angle of the leader with respect to the point orientation, the lower the chances of a strike.

Figure 2:
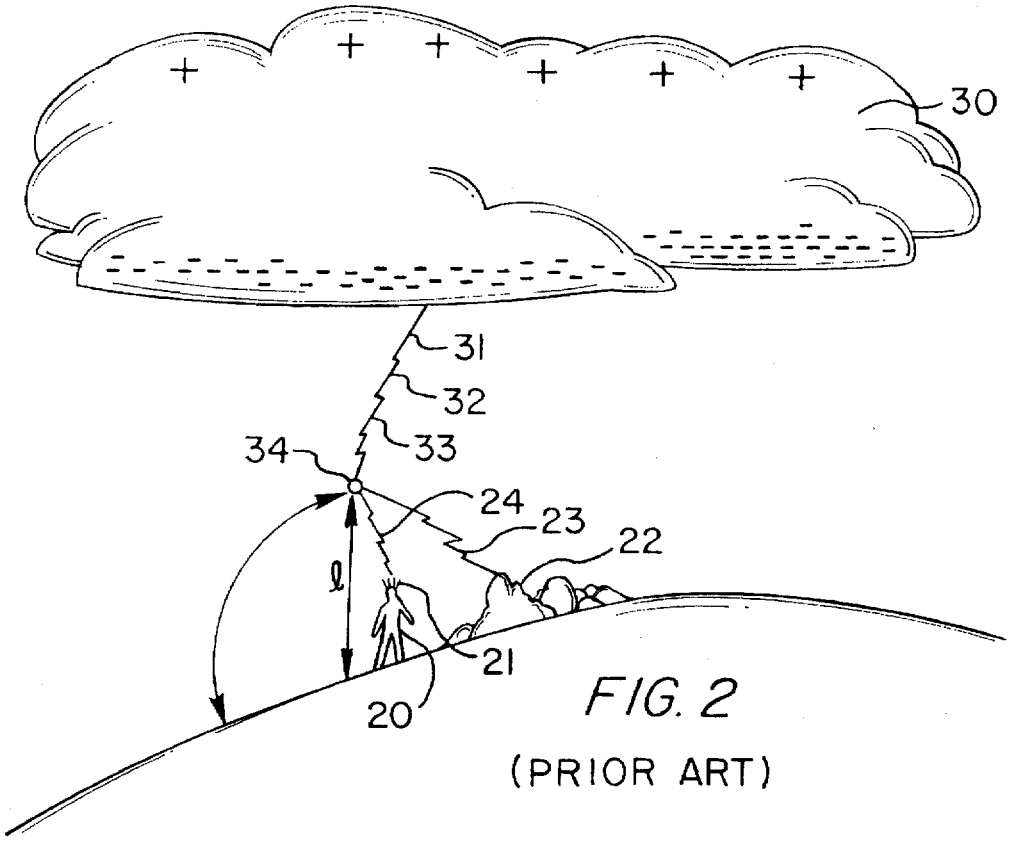
FIG. 2 (PRIOR ART)
FIG. 2 (prior art) is a diagram of a typical lightning strike on an unprotected person.

Everyone has heard of the phenomena of a hiker's hair rising up when a lightning strike is imminent. The sharp points of hair make excellent conductors which enhance the chances of a lightning strike terminating there. FIG. 2 shows the same cloud 30 passing over a hiker 20. The hiker's hair 21 is standing on end. A nearby rock 22 has sent up a streamer 23. The hiker's hair 21 has sent up a streamer 24.

The present invention reduces the chances of creating streamer 24 by offering a smooth, domed metallic surface to the cloud 30. A smooth, domed metallic surface is much less prone to offer up a streamer to the incoming point of discrimination. Thus, lives can be saved.

Figure 3:
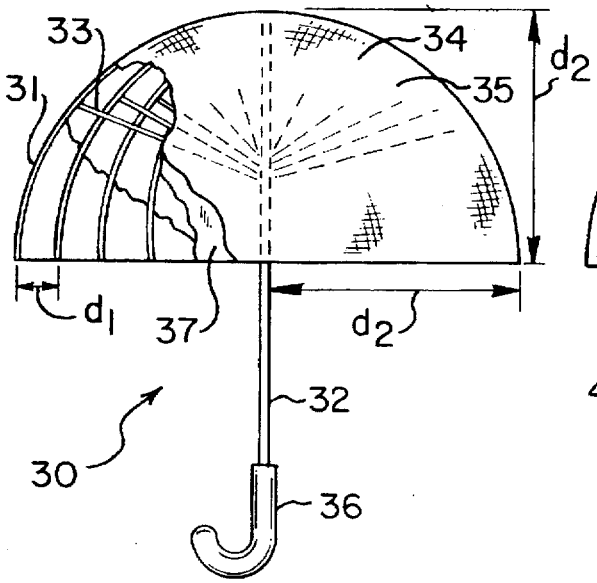
FIG. 3 is a side plan view of an umbrella embodiment.

Referring next to FIG. 3 a shield 30 is built similar to a conventional umbrella. A handle 36 is affixed to a shaft 32 which in turn supports extension rods 33 in a known manner. Extension rods 33, in turn, support a plurality of dome supports 31 in a known manner. The distance d1 must be small enough to support surface 34 in a smooth shape. The closer surface 34 is to a perfect hemisphere, the more efficient the protection. Distance d2 is nominally two feet which is adequate to cover a person's head and shoulders.

Surface 34 is made from a conductive material. Stainless steel woven wire cloth is preferred. Very fine wire is preferred. The holes 35 must be tiny and smooth since any points could induce a lightning strike. An optional waterproof covering 37 could be added, under or over surface 34. Thus, the embodiment would be ideally suited for carrying in a golf bag.

Figure 4:
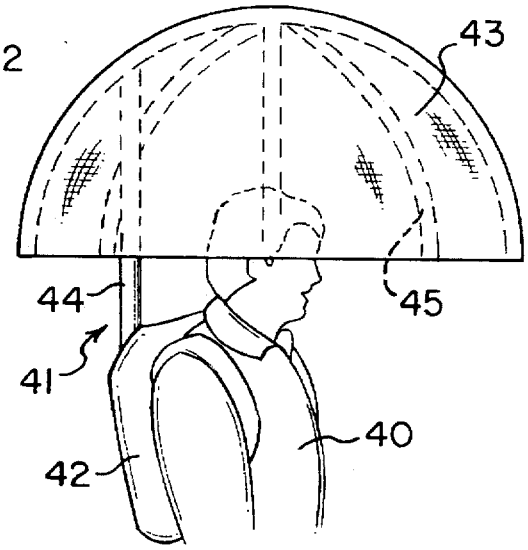
FIG. 4 is a side plan view of the preferred embodiment supported by a backpack.

Referring next to FIG. 4 a hiker 40 is wearing the preferred embodiment, a backpack shield 41. The surface 43 is identical to surface 34 of FIG. 3. A plastic pole 44 supports a plurality of air ribs 45.

Figure 5:
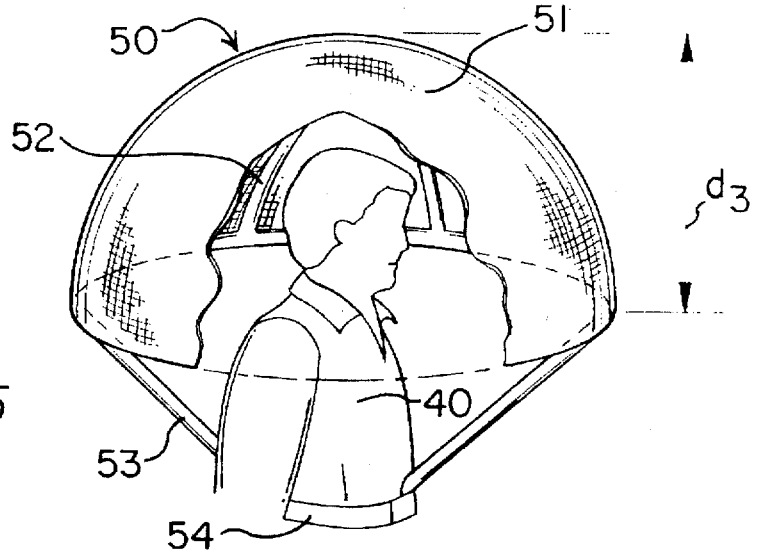
FIG. 5 is a perspective view of an embodiment encircling a person's waist.

Referring next to FIG. 5 the hiker 40 is wearing a waist supported embodiment 50. The surface 51 is identical to surface 34 of FIG. 3. Distance d3 is nominally four feet, enough to surround the hiker's torso. A child (not shown) could be carried by the hiker 40. Additionally the hiker 40 could squat down on the ground and form a dome shaped protective shield in the middle of an open field. The hiker's belt 54 supports a plurality of plastic rods 53 which in turn support the air rib frame 52.

Figure 6:
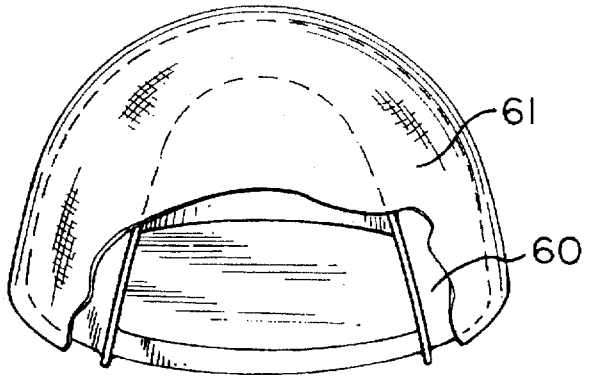
FIG. 6 is a perspective view of an embodiment draped over a tent.

Referring next to FIG. 6 a conventional tent 60 has a general dome shape. A dome-shaped blanket 61 is draped over the tent 60. The blanket 61 has the identical properties as surface 34 of FIG. 3.

Figure 7:
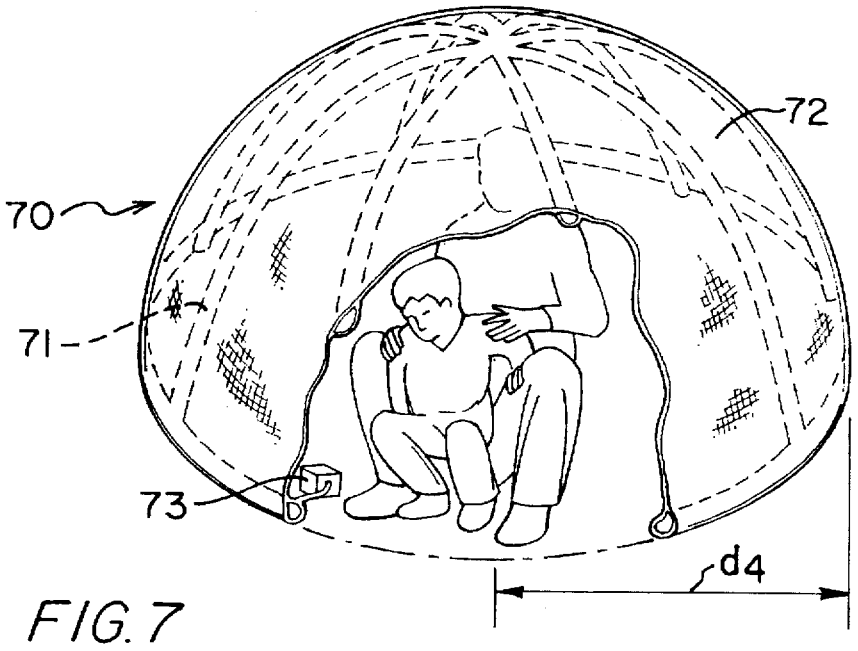
FIG. 7 is a perspective view of an embodiment encompassing an inflatable tent.

Referring next to FIG. 7 a shelter 70 has air ribs 71 to support surface 72. Surface 72 is identical to surface 34 of FIG. 4. Inflator 73 is preferably a compressed air release system having a conventional design. Distance d4 is nominally four feet to accommodate more than one person as shown.

Figure 8:
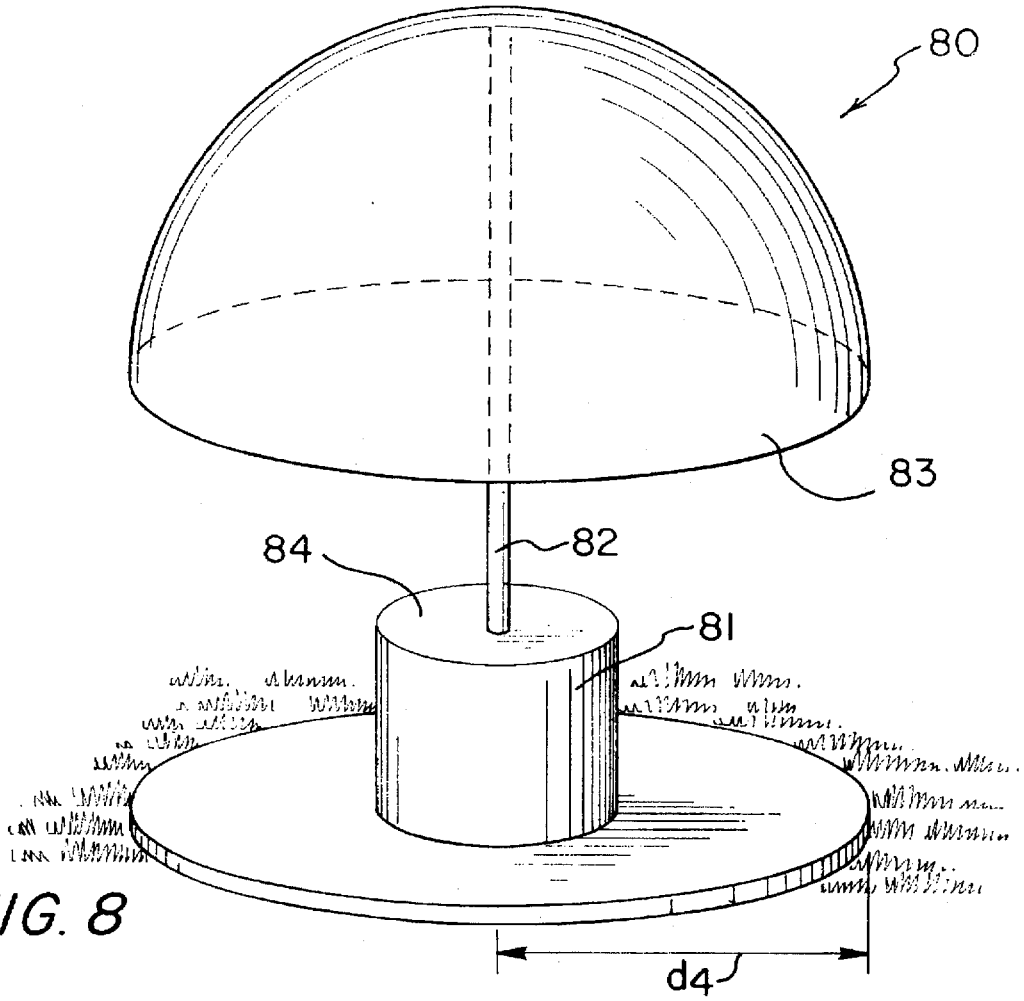
FIG. 8 is a perspective view of a fixed embodiment suited for a golf course.

Referring next to FIG. 8 a stand 80 has a base 81 on which a person could sit at seat 84. A shaft 82 supports dome 83 having the identical properties of surface 34 in FIG. 3. This embodiment is ideally suited for a golf course fairway.

Figure 9:
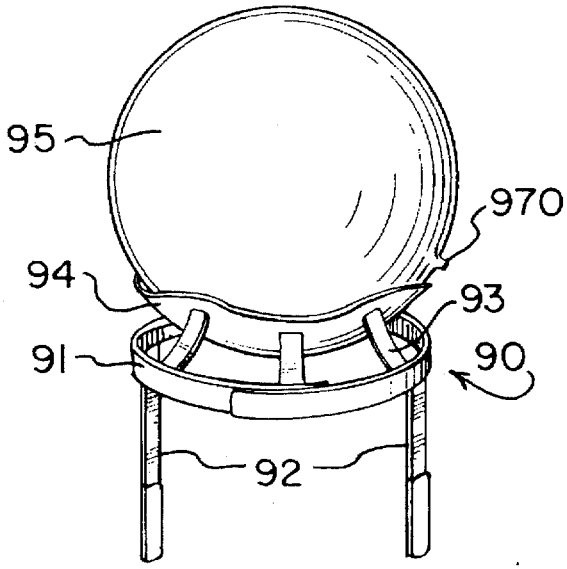
FIG. 9 is a perspective view of a balloon embodiment worn on the head.
Figure 10:
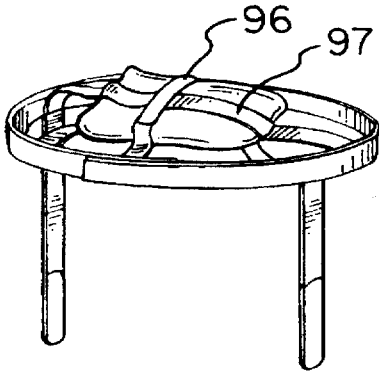
FIG. 10 is a perspective view of the balloon embodiment of FIG. 9 shown in the deflated and secure position.

Referring next to FIG. 9 headgear 90 has a headband 91 and chin straps 92. Support straps 93 support a pouch 94 which holds an inflatable balloon 95. The metallic material should be of a woven fabric derived from very fine round wire. Punched metal creates a higher risk because of the resulting sharp edges. There is an internal bladder (not shown). FIG. 10 shows the balloon 95 in the pouch 94 secured by straps 96, 97. Any known means can be used to inflate the balloon 95 including manually blowing it up with valve 970.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A lightning shield comprising:

a hemispherical dome having a smooth outer surface approximating a perfect hemisphere having a diameter large enough to cover a user's shoulders and head;

said outer surface further comprising a conductive material;

a support means functioning to support the hemispherical dome over a person's head and shoulders; and a lightning ground streamer prevention means comprising a smooth, domed metallic surface on said hemispherical dome.

2. The shield of claim 1, wherein the support means further comprises a hand held non-conductive handle, shaft, and curved ribs.

3. The shield of claim 1, wherein the support means further comprises a support rod assembly affixed to a backpack and an air rib frame.

4. The shield of claim 1, wherein the support means further comprises a waistband having non-conductive support rods and an air rib frame.

5. The shield of claim 1, wherein said conductive material further comprises a metallic mesh.

6. The shield of claim 1, wherein said outer surface further comprises a rain-proof layer.

* * * * *